United States Patent [19]

Jünghans

[11] Patent Number: 4,458,592

[45] Date of Patent: Jul. 10, 1984

[54] DEVICE FOR AXIALLY RECIPROCATING DISTRIBUTOR ROLLERS IN AN INKING UNIT OF A PRINTING MACHINE

[75] Inventor: Rudi Jünghans, Wilhelmsfeld, Fed. Rep. of Germany

[73] Assignee: Heidelberger Druckmaschinen AG, Heidelberg, Fed. Rep. of Germany

[21] Appl. No.: 501,556

[22] Filed: Jun. 10, 1983

Related U.S. Application Data

[63] Continuation of Ser. No. 286,451, Jul. 24, 1981, abandoned.

[30] Foreign Application Priority Data

Jul. 26, 1980 [DE] Fed. Rep. of Germany ..... 3028406

[51] Int. Cl.[3] ..... B41F 31/14; B41F 31/30

[52] U.S. Cl. ..... 101/349; 101/DIG. 14

[58] Field of Search ..... 101/DIG. 14, 348, 349, 101/350–352, 148, 355, 356, 357, 358, 360, 361, 362

[56] References Cited

U.S. PATENT DOCUMENTS

| | | | |
|---|---|---|---|
| 1,376,982 | 5/1921 | Walser et al. | 101/DIG. 14 |
| 1,741,414 | 12/1929 | Graf | 101/350 |
| 1,861,073 | 5/1932 | Wood | 101/350 |
| 2,506,778 | 5/1950 | Grafts et al. | 101/DIG. 14 |
| 2,581,687 | 1/1952 | McWhorter | 101/DIG. 14 |
| 3,994,222 | 11/1976 | Pullen | 101/349 |

*Primary Examiner*—J. Reed Fisher

*Attorney, Agent, or Firm*—Herbert L. Lerner; Laurence A. Greenberg

[57] ABSTRACT

Device for axially reciprocating distributor rollers in an inking unit of a printing machine having an eccentric drive operatively connected with a push rod and control levers, which are mounted through the intermediary of slide bearings on a lateral frame of the printing machine, for respectively reciprocating the distributor rollers, the control levers being coupled to one another by coupling members, including shaft journals for the respective distributor rollers whereon respective journal bearings are rotatably mounted, the journal bearings having respective pivot pins extending therefrom and carrying respective universal joints, the universal joints being mounted in the control levers respectively.

3 Claims, 3 Drawing Figures

18
30
42
46

19
30
45
44
35
34
34
35
36
41
35
34
35
40
37
38
49
30
21
47
40
35
22
31
30
34
43
35
39
48
49
22'
34
30
35

DEVICE FOR AXIALLY RECIPROCATING DISTRIBUTOR ROLLERS IN AN INKING UNIT OF A PRINTING MACHINE

This is a continuation of application Ser. No. 286,451, filed July 24, 1981, now abandoned.

The invention relates to a device for axially reciprocating distributor rollers in an inking unit of a printing machine and, more particularly, to such a device having an eccentric drive operatively connected with a push rod and control levers, which are mounted through the intermediary of slide bearings on a lateral frame of the printing machine, for respectively reciprocating the distributor rollers, the control levers being coupled to one another by coupling members.

In a heretofore known construction of this general type disclosed in U.S. Pat. No. 1,610,223 cam followers are disposed at the ends of control levers and engage in a groove formed in grooved rollers which, in turn, are fixed on shaft journals or trunnions of the distributor rollers. The width of the respective groove is greater by a given amount than the diameter of the cam follower rollers so that the latter can, respectively, roll on the driving flank of the groove.

In this heretofore known construction, the cam follower roller, depending upon the direction of movement of the distributor roller, first rolls on one flank of the groove formed in the grooved roller and, during the reverse or return movement, on the other flank thereof. Because the distributor roller always rotates in one rotary direction, the cam follower roller is driven first in one and then in the other rotary direction, depending upon the direction of stroke or motion of the distributor roller. This necessitates, respectively, a reversal or changeover in the rotary direction, occurring about one hundred fifty times per minute for high-speed printing machines. Each cam follower roller must then be braked down from a speed of about 2000 RPM and then re-accelerated in the opposite rotary direction. The change in rotary direction causes increased wear of the cam follower roller per se and also of both flanks of the groove in the grooved roller. Furthermore, lateral play is thereby increased so that the reciprocatory movement of the distributor roller can no longer be effected without jolting or jarring. With present-day printing machine performance or output, the aforementioned heretofore known construction is subjected to critical forces or loads so that, in addition to wear, a limit to the performance or output of the machine is also set thereby.

It is accordingly an object of the invention to provide a device having minimal play and wear for laterally reciprocating the distributor rollers in an inking unit of a printing machine which is installable even when limited space is available and which ensures jolt-free reversal of the direction of movement. With the foregoing and other objects in view, there is provided, in accordance with the invention, a device for axially reciprocating distributor rollers in an inking unit of a printing machine having an eccentric drive operatively connected with a push rod and control levers, which are mounted through the intermediary of slide bearings on a lateral frame of the printing machine, for respectively reciprocating the distributor rollers, the control levers being coupled to one another by coupling members, comprising shaft journals for the respective distributor rollers whereon respective journal bearings are rotatably mounted, the journal bearings having respective pivot pins extending therefrom and carrying respective universal joints, the universal joints being mounted in the control levers respectively.

The construction of the device according to the invention has the advantage that exact and largely wear-free coupling of the distributor rollers with the control levers and jolt-free reversal of the direction of movement is assured. In addition to the low space requirement, bearing parts which are obtainable relatively easily in the market place can be used.

In accordance with another feature of the invention, a plurality of the journal bearings rotatably mounted on the respective shaft journals of the distributor rollers are coupled, respectively, with the respective control levers through the intermediary of the universal joints, whereby the control levers are coupled to one another.

In accordance with a concommitant feature of the invention, at least one of the journal bearings has a plurality of pivot pins extending therefrom, each of which is coupled through the intermediary of a respective universal joint with a respective control lever.

These additional features of the invention permit any desired or required number of the distributor rollers to be driven, in a relatively simple manner and to be reciprocatingly moved in any desired or required direction, also, the distributor rollers can be constructed or accommodated to the respective requirements with respect to the distributing speed and stroke length thereof without any additional axpense.

Other features which are considered as characteristic for the invention are set forth in the appended claims.

Although the invention is illustrated and described herein as embodied in a device for axially reciprocating distributor rollers in an inking unit of a printing machine, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which.

Figure 1:
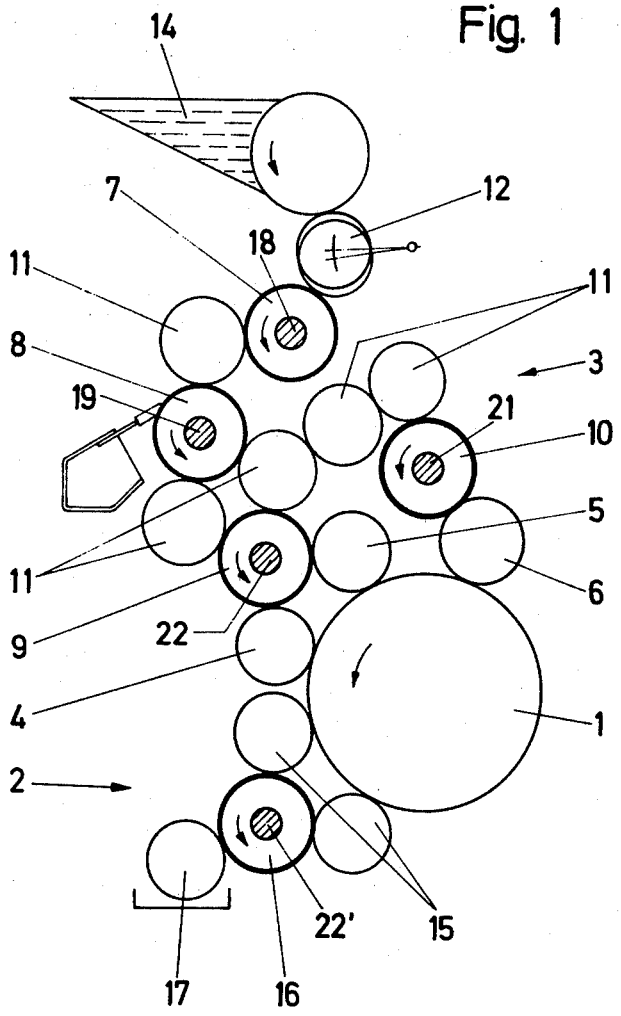
FIG. 1 is a diagrammatic side elevational view of an inking unit of a printing machine incorporating a device for axially reciprocating distributor rollers thereof in accordance with the invention.
Figure 2:
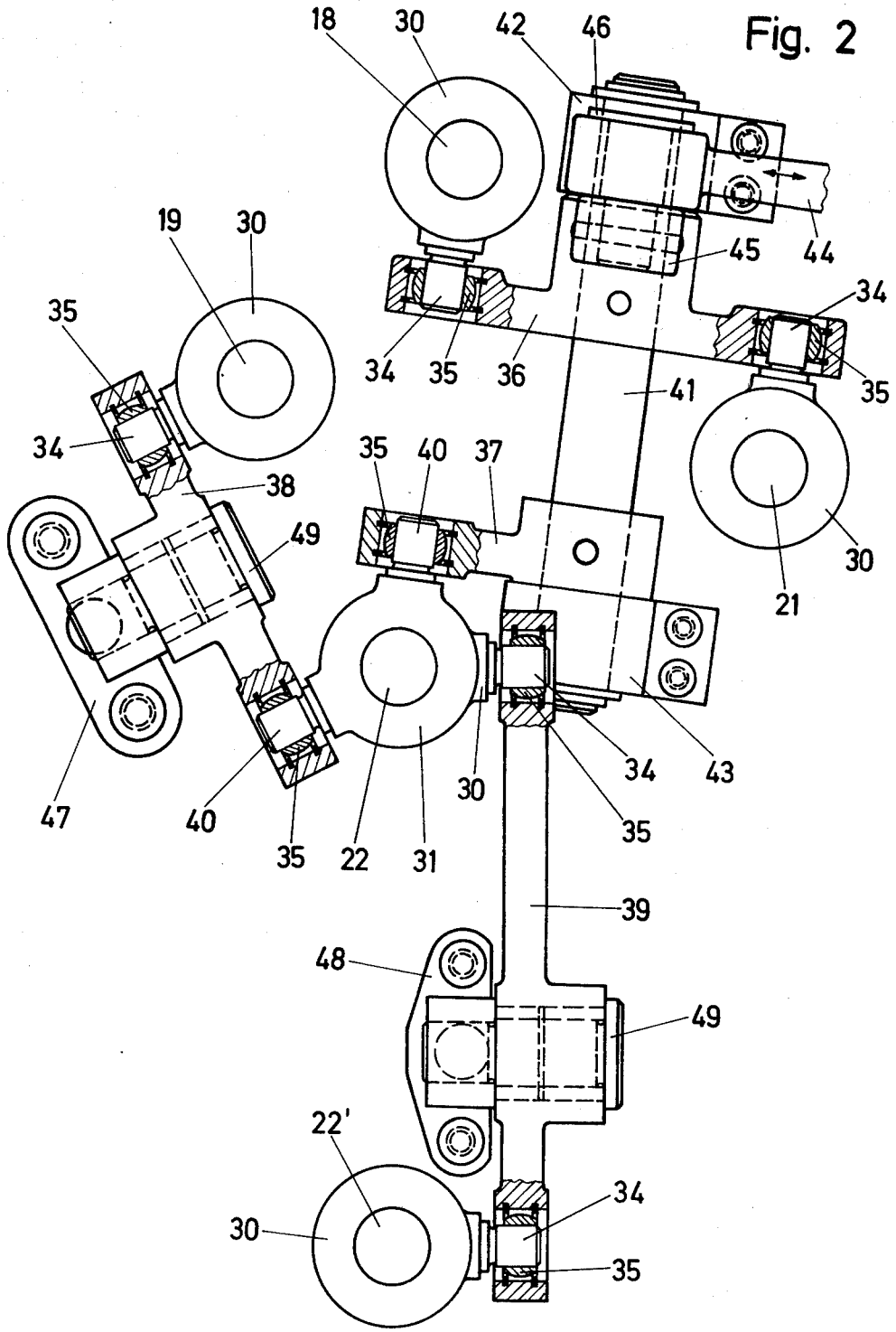
FIG. 2 is a plan view, partly in section, of the device for axially reciprocating the distributor rollers.
Figure 3:
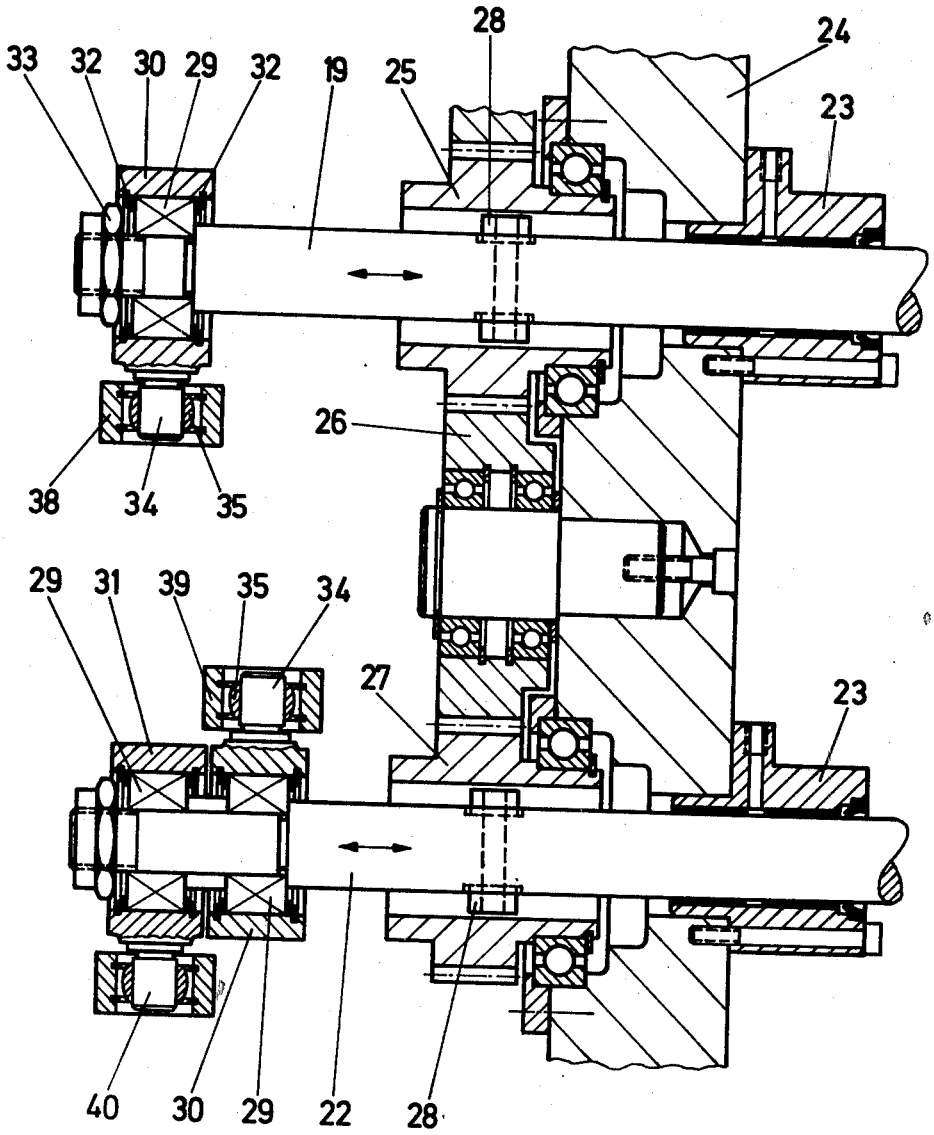
FIG. 3 is an enlarged fragmentary sectional view of the device according to the invention showing two of the distributor rollers of the inking unit.

Referring now to the drawing and first, particularly to FIG. 1 thereof, there is shown a dampening unit 2 and an inking unit 3 associated with a plate cylinder 1. The inking unit 3 is formed of ink applicator or forme rollers 4,5 and 6, ink distributor rollers 7,8,9 and 10, further inking unit rollers 11, a ductor roller 12, an ink duct roller 13 and an ink duct 14 with ink. The dampening unit 2 has two dampening-liquid applicator or forme rollers 15, a dampening-liquid distributor roller 16 and a dampening-liquid ductor roller 17 to which dampening liquid is fed. Shaft journals or trunnions 18 to 22 (FIG. 2) are operatively associated with the distributor rollers 7 to 10 and 16, respectively (FIG. 1). The distributor rollers 7 to 10 and 16 are rotatably mounted through the intermediary of the journals 18 to 22 in bearings 23 in a conventional manner, as shown in FIG. 3, the bearings 23, in turn, being fixed to a lateral frame 24 of the printing machine. The distributor rollers 7 to 10 and 16 are driven by gears 25, 26 and 27, reciprocating movement of the reciprocating rollers 7 to 10 and 16 being effected by providing sliding keys 28 on the journals 18 to 22.

Journal bearings 30 and 31 are rotatably mounted through the intermediary of ball bearings 29 on the shaft journals 18 to 22 and are, in turn, fixed against lateral movement by respective circlips 32 and nuts 33. The journal bearings 30 have a respective pivot or wrist pin 34 carrying a universal or ball-and-socket joint 35 mounted in a respective control lever 36 to 39. The journal bearing 31 is provided with tow pivot pins 40 which are mounted through the intermediary of universal or ball-and-socket joints 35, respectively, in control levers 37 and 38, respectively. Coupling of the two control levers 37 and 38 and consequent force transmission is thereby effected. As shown in FIG. 2, when a journal bearing 31 is additionally mounted on the shaft journal 20, and the pivot or wrist pin 34 thereof connected through the intermediary of a universal or ball-and-socket joint 35 to the control lever 39, the distributor roller 16 is thereby also reciprocated.

The control levers 36 and 37 are fixed on a shaft 41 which is mounted in bearings 42 and 43 on the frame of the printing machine. The shaft 41 receives a pivoting or swiveling movement from a push rod 44, which, in a conventional manner, for example by means of an eccentric drive, is given a reciprocating motion, and from a lever arm 45 provided on the control lever 36. The connection therebetween is effected by a pin or bolt 46. The reciprocation of the push rod 44 is thus transmitted to the levers 36 and 37 and, from the latter, in turn, to the journal bearings 30 and 31 from which it is transmitted to the control levers 38 and 39. The two control levers 38 and 39 are also mounted through the intermediary of flange bearings 47 and 48, respectively, on the lateral frame 24 of the printing machine. Bearing pins 49 are provided in the flange bearings 47 and 48, the respective control levers 38 and 39 being rotatably mounted thereon.

It is advantageous if the respective pins 34 of the journal bearings 30 and 31 are disposed at an angle of about 90° to the control levers 36 to 39 respectively associated therewith. When disposing or arranging two pivots or pins 40 on the journal bearing 31, it is necessary that the two control levers 37 and 38, beginning from the center of rotation thereof, have the same turning radius and, as shown in FIG. 2, respectively approach the journal bearing 31 in the same direction. Instead of universal or ball-and-socket joints, it is also possible to form the pivots or pins 34 and 40 spherically and to mount them through the intermediary of bearing bushings in the control levers 36 to 39.

There is claimed:

1. Device for axially reciprocating distributor rollers in an inking unit of a printing machine having distributor rollers with respective journal bearings, and respective shaft journals wherein the journal bearings are rotatably mounted, the journal bearings being formed with respective pivot pins, the shaft journals being axially slidable in bearings carried by a lateral frame of the printing machine for axially reciprocating the distributor rollers, comprising control levers wherein the respective pivot pins are rotatably mounted, means for driving said control levers to perform a swinging movement, said control levers coupling the shaft journals of the distributor rollers to one another, said control levers engaging with the respective journal bearings provided on the shaft journals, the pivot pins of the journal bearing being pivotable in ball and socket bearings having respective outer rings fastened to the respective control levers, said control levers being mutually coupled via the journal bearings and said ball and socket bearings and being supported on said lateral frame of the printing machine.

2. Device according to claim 1 wherein the distributor rollers of the inking unit include a first distributor roller and a plurality of additional distributor rollers arranged thereafter in a drive train, and a plurality of journal bearings are rotatably mounted on the shaft journal of said first distributor roller so that axial movement of said additional distributor rollers is derivable from said first distributor roller.

3. Device according to claim 1 wherein each of said pivot pins is coupled with one of said control levers, respectively, via said ball and socket bearings, respectively.

* * * * *